US009458545B2

(12) United States Patent
Wedde

(10) Patent No.: US 9,458,545 B2
(45) Date of Patent: Oct. 4, 2016

(54) METHOD OF VENTILATING AN ALUMINUM PRODUCTION ELECTROLYTIC CELL

(75) Inventor: Geir Wedde, Oslo (NO)

(73) Assignee: General Electric Technology Ltd, Baden (CH)

( * ) Notice: Subject to any disclaimer, the term of this patent is extended or adjusted under 35 U.S.C. 154(b) by 360 days.

(21) Appl. No.: 13/522,987

(22) PCT Filed: Jan. 11, 2011

(86) PCT No.: PCT/IB2011/000032

§ 371 (c)(1),
(2), (4) Date: Oct. 10, 2012

(87) PCT Pub. No.: WO2011/089497

PCT Pub. Date: Jul. 28, 2011

(65) Prior Publication Data

US 2013/0048508 A1 Feb. 28, 2013

(30) Foreign Application Priority Data

Jan. 21, 2010 (EP) ..... 10151325

(51) Int. Cl.
*C25C 3/22* (2006.01)
*C25C 3/14* (2006.01)

(52) U.S. Cl.
CPC ..... *C25C 3/22* (2013.01)

(58) Field of Classification Search
CPC ..... C25C 3/06–3/24
USPC ..... 204/247; 205/372–396
See application file for complete search history.

(56) References Cited

U.S. PATENT DOCUMENTS

| | | | | |
|---|---|---|---|---|
| 2,947,673 | A | 8/1960 | Sem et al. | |
| 3,664,935 | A | 5/1972 | Johnson | |
| 4,451,337 | A | 5/1984 | Frilund et al. | |
| 5,045,168 | A | 9/1991 | Dalen et al. | |
| 5,484,535 | A | 1/1996 | Downs | |
| 5,814,127 | A | 9/1998 | Li | |
| 5,885,539 | A | 3/1999 | Bjarnø et al. | |
| 2004/0194513 | A1 * | 10/2004 | Giacobbe et al. | 65/512 |

(Continued)

FOREIGN PATENT DOCUMENTS

| | | | |
|---|---|---|---|
| CN | 101031673 | A | 9/2007 |
| CN | 101435089 | A | 5/2009 |

(Continued)

OTHER PUBLICATIONS

Office action issued from Chinese Patent Office dated Jul. 10, 2014 for CN Application No. 201180015256.4.

(Continued)

*Primary Examiner* — Ciel Thomas
(74) *Attorney, Agent, or Firm* — Rita D. Vacca

(57) ABSTRACT

An aluminium production electrolytic cell (4) comprises a bath (8) with bath contents (8*a*), at least one cathode electrode (10) in contact with said contents (8*a*), at least one anode electrode (6) in contact with said contents (8*a*), and a hood (16), defining interior area (16*a*), covering at least a portion of said bath (8). The electrolytic cell (4) is equipped for vent gases to be drawn from said interior area (16*a*). The electrolytic cell (4) also comprises at least one heat exchanger (52) for cooling at least a portion of the vent gases drawn from interior area (16*a*), prior to circulation thereof to interior area (16*a*).

8 Claims, 6 Drawing Sheets

(56) References Cited

U.S. PATENT DOCUMENTS

| | | | | |
|---|---|---|---|---|
| 2006/0172176 | A1* | 8/2006 | MacBain et al. | 429/38 |
| 2007/0261826 | A1* | 11/2007 | Holmen et al. | 165/138 |
| 2008/0072762 | A1 | 3/2008 | Gal | |
| 2009/0159434 | A1 | 6/2009 | Girault et al. | |

FOREIGN PATENT DOCUMENTS

| | | | | |
|---|---|---|---|---|
| DE | 198 45 258 | | 8/1960 | |
| DE | 19845258 | C1 | 3/2000 | |
| EP | 0162536 | | 11/1985 | |
| RU | 2061797 | C1 | 6/1996 | |
| RU | 2321687 | C2 | 4/2008 | |
| WO | WO 2008113496 | A1 * | 9/2008 | C25C 3/22 |

OTHER PUBLICATIONS

English translation of Official Action of Substantive Examination issued on Dec. 12, 2014 by the Russian Patent Office in corresponding Russian Application No. 2012135688/02.

Decision of Grant issued from Russian Patent Office dated May 28, 2015 for RU Application No. 2012135688.

* cited by examiner

METHOD OF VENTILATING AN ALUMINUM PRODUCTION ELECTROLYTIC CELL

FIELD OF THE INVENTION

The present invention relates to a method of ventilating an aluminium production electrolytic cell, the aluminium production electrolytic cell comprising a bath with contents, at least one cathode electrode being in contact with said bath contents, at least one anode electrode being in contact with said bath contents, and a hood covering at least a portion of said bath.

The present invention also relates to a ventilating device for an aluminium production electrolytic cell of the above referenced type.

BACKGROUND OF THE INVENTION

Aluminium is often produced by means of an electrolysis process using one or more aluminium production electrolytic cells. One such process is disclosed in US 2009/0159434. Such electrolytic cells, typically comprise a bath for containing bath contents comprising fluoride containing minerals on top of molten aluminium. The bath contents are in contact with cathode electrode blocks, and anode electrode blocks. Aluminium oxide is supplied on regular intervals to the bath via openings at several positions along the center of the cell and between rows of anodes.

Aluminium so produced generates effluent gases, including hydrogen fluoride, sulphur dioxide, carbon dioxide and the like. These gases must be removed and disposed of in an environmentally conscientious manner. Furthermore, the heat generated by such an electrolysis process must be controlled in some manner to avoid problems with the overheating of equipment located near the bath. As described in US 2009/0159434, one or more gas ducts may be used to draw effluent gases and dust particles from a number of parallel electrolytic cells and to remove generated heat from the cells to cool the cell equipment. To accomplish the same, a suction is generated in the gas ducts by means of a pressurized air supply device. This suction then creates a flow of ambient ventilation air through the electrolytic cells. The flow of ambient ventilation air through the electrolytic cells cools the electrolytic cell equipment and draws the generated effluent gases and dust particles therefrom. Such a flow of pressurized air likewise creates a suitable gas flow through the electrolytic cells and the gas ducts to carry the generated effluent gases and dust particles to a gas treatment plant.

SUMMARY OF THE INVENTION

An object of the present invention is to provide a method of removing gaseous pollutants, dust particles and heat from an aluminium production electrolytic cell that is more efficient with respect to required capital investment and ongoing operating costs than the method of the prior art.

The above-noted object is achieved by a method of ventilating an aluminium production electrolytic cell, which requires no or a reduced volume of ambient air. The aluminium production electrolytic cell comprises a bath, bath contents, at least one cathode electrode being in contact with said bath contents, at least one anode electrode being in contact with said bath contents, and a hood covering at least a portion of said bath. The subject method comprises:

drawing vent gases from an interior area of said hood, cooling at least a portion of said vent gases to obtain cooled vent gases, and returning at least a portion of the cooled vent gases to the interior area of said hood.

An advantage of the above-described method is that the volume of vent gases requiring cleaning is significantly less than that of the prior art since large volumes of ambient air are not added thereto. Likewise, without the diluting effects of the large volumes of ambient air, the vent gases drawn for cleaning carry higher concentrations of pollutants, such as hydrogen fluoride, sulphur dioxide, carbon dioxide, dust particles and the like therein. Vent gases with higher concentrations of pollutants make downstream equipment, such as for example a vent gas treatment unit, a carbon dioxide removal device and the like, work more efficiently. Furthermore, downstream equipment can be made smaller in size due to reduced capacity demands based on the reduced vent gas volumes passing therethrough. Such reductions in equipment size and capacity requirements reduces the required capital investment and ongoing operating costs of the system. A further advantage is that by removing, cooling and returning vent gases to the interior area of the hood, the volume of ambient air required is reduced or even eliminated. Reducing or even eliminating the use of ambient air in the system reduces the quantity of moisture transported by vent gases to downstream equipment, such as for example, a downstream gas treatment unit. Moisture is known to strongly influence the rate of hard grade scale and crust formation on equipment in contact with vent gases. Hence, with a reduced amount of moisture in the vent gases, the formation of scale and crust is reduced. Reducing the formation of scale, crust and deposits reduces the risk of equipment clogging, such as for example the clogging of heat exchangers and fans utilized in vent gascirculation.

According to one embodiment, 10-80% of a total quantity of vent gases drawn from the interior area of the hood are returned back to the interior area after cooling at least a portion of the vent gases. An advantage of this embodiment is that the hood and the electrolytic cell equipment located in the upper portion of the hood are sufficiently cooled by the cooled vent gases. Likewise, a suitable concentration of pollutants within the vent gases is reached prior to cleaning thereof in downstream equipment. The use of cooled vent gases to cool the electrolytic cell reduces or eliminates the volume of ambient air required for cooling. Still another advantage of this embodiment is that the hot vent gases drawn from the interior area for cooling provide high value heat to a heat exchanger, which may be used for other system processes.

According to another embodiment, the method further comprises cooling the full volume of vent gases drawn from the hood interior area by means of a first heat exchanger. A portion of the cooled vent gases then flow to a second heat exchanger for further cooling before at least a portion thereof returns to the interior area of the hood. An advantage of this embodiment is that cooling to a first temperature in a first heat exchanger is commercially feasible for the entire volume of vent gases drawn from the hood interior area. Such cooling of the vent gases by the first heat exchanger is suitable to adequately cool the vent gases for the temperature needs of downstream equipment, such as for example a gas treatment unit. Further cooling of a portion of vent gases to a second lower temperature using a second heat exchanger is particularly useful for vent gases returned to the hood interior area. Hence, the portion of the vent gases used to cool the interior area is efficiently cooled to a lower temperature than that of the portion of the vent gases that flow to downstream equipment, such as for example a gas treatment unit.

According to one embodiment, the cooling medium is first passed through the second heat exchanger, and then passed through the first heat exchanger. Hence, the portion of the vent gases that is to be returned to the interior area of the hood is first cooled in the first heat exchanger, and then in the second heat exchanger, while the cooling medium is first passed through second heat exchanger and then passed through first heat exchanger, making the cooling medium cooling the portion of the vent gases in a counter-current mode in the first and second heat exchangers. An advantage of this embodiment is that the cooling of the returned vent gases, and the heating of the cooling medium in the counter-current mode is very efficient.

According to another embodiment, the cooled vent gases to be returned to the hood interior area first flow through a gas treatment unit for removal of at least some hydrogen flouride, and/or sulphur dioxide and/or dust particles present therein. An advantage of this embodiment is that the cooled vent gases are comparably clean, i.e., relatively free of effluent gases and/or dust particles, which may reduce the risk of corrosion and abrasion of equipment in the hood interior area, ducts, dampers, heat exchangers, fans and the like, in contact with the cooled vent gases. Such cleaning of cooled vent gases may also reduce health risks associated with exposure to untreated "dirty" vent gases.

According to another embodiment, at least a portion of the cooled vent gases is returned to the interior area of the hood in a manner that causes the returned cooled vent gases to form a cool "curtain" of gas around an aluminium oxide powder feeding position at which aluminium oxide powder is supplied to the bath. An advantage of this embodiment is that heat and gases and dust particles generated during the feeding of aluminium oxide to the bath are efficiently controlled and managed with little or no use of ambient air.

According to one embodiment, at least a portion of the cooled vent gases is returned to an upper portion of the hood interior area. An advantage of this embodiment is that the risk of excessive temperatures at the upper portion of the hood interior area due to the rise of hot gases is reduced thus lessening the thermal load on electrolytic cell equipment arranged in the upper portion of the hood interior area.

According to one embodiment, at least a portion of the dust particles of the vent gases are removed therefrom prior to vent gas cooling in the first heat exchanger. An advantage of this embodiment is that it reduces abrasion and/or clogging of the heat exchanger or like cooling device or fan, by dust particles of the vent gases.

A further object of the present invention is to provide an aluminium production electrolytic cell, which is more efficient with regard to treatment equipment operating costs than that of the prior art.

This object is achieved by means of an aluminium production electrolytic cell comprising a bath, bath contents, at least one cathode electrode being in contact with said bath contents, at least one anode electrode being in contact with said bath contents, a hood covering at least a portion of said bath, an interior area defined by said hood, and at least one suction duct fluidly connected to the interior area for removing vent gases from said interior area, and further comprising at least one heat exchanger for cooling at least a portion of the vent gases drawn from said interior area by means of the suction duct, and at least one return duct for circulating at least a portion of the vent gases cooled by the heat exchanger to the hood interior area.

An advantage of this aluminium production electrolytic cell is that at least a portion of the vent gases is cooled and reused rather than discarded and replaced by adding cool, diluting, humid, ambient air. Thus, with the reduced vent gas flow since little or no ambient air is added thereto, cleaning equipment operates more efficiently, and equipment size and capacity requirements may be reduced.

According to one embodiment a fan is connected to the return duct to circulate vent gases to the hood interior area. An advantage of this embodiment is that an even and controllable flow of returned cooled vent gases to the hood interior area is achieved.

According to one embodiment, the "at least one heat exchanger" is a first heat exchanger for cooling vent gases drawn from the hood interior area, a second heat exchanger being located in the return duct for further cooling the cool vent gases returned to the hood interior area. An advantage of this embodiment is that cooling of the vent gases for return to the interior area can be combined with the cooling of the vent gases for cleaning treatment, for added efficiency.

According to one embodiment, a first pipe is provided for flow of a cooling medium from a cooling medium source to the second heat exchanger, a second pipe is provided for flow of the cooling medium from the second heat exchanger to the first heat exchanger, and a third pipe is provided for flow of the cooling medium from the first heat exchanger to a cooling medium recipient. An advantage of this embodiment is that the temperature of the cooling medium leaving the first heat exchanger can be relatively high, e.g., only about 10°-30° C. lower than the temperature of the vent gases being drawn from the hood interior area, thereby making such cooling medium useful for heating purposes in other parts of the process.

According to one embodiment, the return duct is a combined tending and return duct, a return gas fan being arranged for forwarding returned vent gases through said combined tending and return duct to the hood interior area in a first operating mode, the combined tending and return duct being arranged for transporting vent gases from the hood interior area in a second operating mode. An advantage of this embodiment is that the same return duct can be utilized for returning just cooled vent gases to the interior area during normal operation and for causing an increased pull of vent gases from the hood interior area during electrolytic cell maintenance and tending, i.e., adding consumables to the cell, replacing spent carbon anodes, covering cells with recycled bath contents and aluminium oxide, and the like.

According to another embodiment, the aluminium production electrolytic cell comprises at least one aluminium oxide feeder which is arranged above the bath for supplying aluminium oxide powder to the bath, and a return duct fluidly connected to a cover of the aluminium oxide feeder for feeding returned cooled vent gases to said cover. An advantage of this embodiment is that removal of gases and dust particles generated during the feeding of aluminium oxide powder to the bath may be accomplished more efficiently since little or no ambient air is added to the process.

According to another embodiment, said cover is a double-walled cover having an outer wall and an inner wall, a first space defined by the interior of the outer wall and the exterior of the inner wall through which returned cooled vent gases flow, and a second space defined by the interior of the inner wall through which vent gases flow. An advantage of this cover is that gases and dust particles can be very efficiently collected and removed from the cell at the aluminium oxide feeder.

According to another embodiment, the return duct is fluidly connected to the first space of the cover of the aluminium oxide feeder to supply cooled vent gases to said first space, and a suction duct is fluidly connected to the second space to draw gas and dust particle filled vent gases from the second space.

Further objects and features of the present invention will be apparent from the following detailed description and claims.

BRIEF DESCRIPTION OF THE DRAWINGS

The invention is described in more detail below with reference to the appended drawings in which.

DETAILED DESCRIPTION OF PREFERRED EMBODIMENTS

Figure 1:
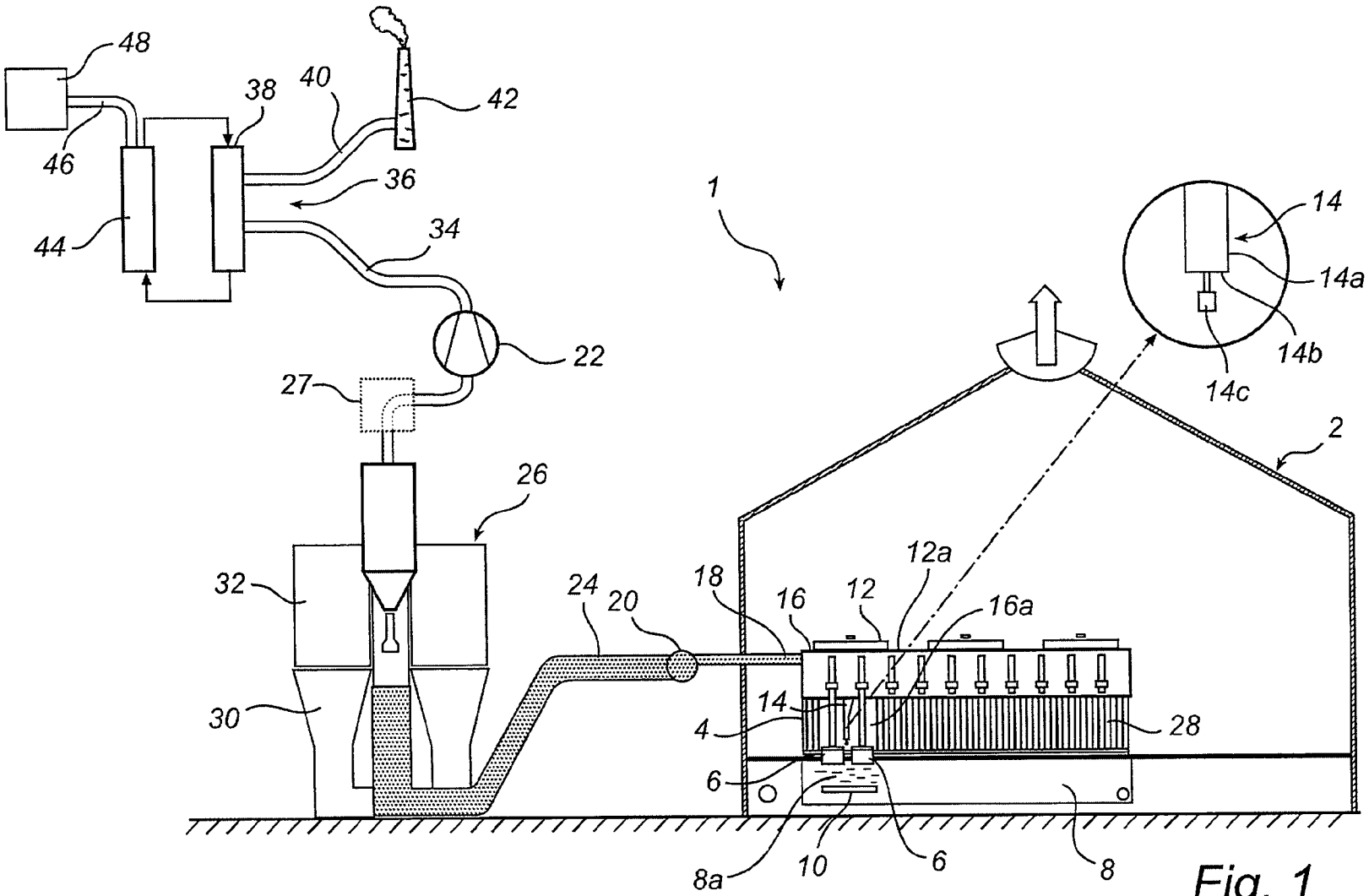
FIG. 1 is a schematic side view of an aluminium production plant.

FIG. 1 is a schematic representation of an aluminium production plant 1. The main components of aluminium production plant 1 is an aluminium production electrolytic cell room 2 in which a number of aluminium production electrolytic cells may be arranged. In FIG. 1 only one aluminium production electrolytic cell 4 is depicted for purposes of clarity and simplicity, but it will be appreciated that electrolytic cell room 2 may typically comprise 50 to 200 electrolytic cells. The aluminium production electrolytic cell 4 comprises a number of anode electrodes 6, typically six to thirty anode electrodes that are typically arranged in two parallel rows extending along the length of cell 4 and extend into contents 8*a* of bath 8. One or more cathode electrodes 10 are also located within bath 8. The process occurring in the electrolytic cell 4 may be the well-known Hall-Héroult process in which aluminium oxide which is dissolved in a melt of fluorine containing minerals is electrolysed to form aluminium, hence the electrolytic cell 4 functions as an electrolysis cell. Powdered aluminium oxide is fed to electrolytic cell 4 from a hopper 12 integrated in a superstructure 12*a* of electrolytic cell 4. Powdered aluminium oxide is fed to the bath 8 by means of feeders 14. Each feeder 14 may be provided with a feeding pipe 14*a*, a feed port 14*b* and a crust breaker 14*c* which is operative for forming an opening in a crust that often forms on the surface of contents 8*a*. An example of a crust breaker is described in U.S. Pat. No. 5,045,168.

The electrolysis process occurring in electrolytic cell 4 generates large amounts of heat and also dust particles and effluent gases including but not limited to hydrogen fluoride, sulphur dioxide and carbon dioxide. A hood 16 is arranged over at least a portion of the bath 8 and defines interior area 16*a*. A suction duct 18 is fluidly connected to interior area 16*a* via hood 16. Similar suction ducts 18 of all parallel electrolytic cells 4 are fluidly connected to one collecting duct 20. A fan 22 draws via suction duct 24 vent gases from collecting duct 20 to a gas treatment unit 26. Fan 22 is preferably located downstream of gas treatment unit 26 to generate a negative pressure in the gas treatment unit 26. However, fan 22 could also, as alternative, be located in suction duct 24. Fan 22 creates via fluidly connected suction duct 18, collecting duct 20 and suction duct 24, a suction in interior area 16*a* of hood 16. Some ambient air will, as a result of this suction, be sucked into interior area 16*a* mainly via openings formed between side wall doors 28, some of which have been removed in the illustration of FIG. 1 to illustrate the anode electrodes 6 more clearly. Some ambient air will also enter interior area 16*a* via other openings, such as openings between covers (not shown) and panels (not shown) making up the hood 16 and superstructure 12*a* of electrolytic cell 4. Ambient air sucked into interior area 16*a* by means of fan 22 will cool the internal structures of electrolytic cell 4, including, for example, anode electrodes 6, and will also entrain the effluent gases and dust particles generated in the electrolysis of the aluminium oxide. The vent gases leaving interior area 16*a* will, hence, comprise a mixture of ambient air, effluent gases and dust particles generated in the aluminium production process.

In gas treatment unit 26, vent gases are mixed in contact reactor 30, with an absorbent, which may typically be aluminium oxide that is later utilized in the aluminium production process. Aluminium oxide reacts with some components of the vent gases, in particular, hydrogen fluoride, HF, and sulphur dioxide, $SO_2$. The particulate reaction products formed by the reaction of aluminium oxide with hydrogen fluoride and sulphur dioxide are then separated from the vent gases by fabric filter 32. In addition to removing hydrogen fluoride and sulphur dioxide from the vent gases, gas treatment unit 26 via fabric filter 32 also separates at least a portion of the dust particles that are entrained with the vent gases from interior area 16*a*. An example of a suitable gas treatment unit 26 is described in more detail in U.S. Pat. No. 5,885,539.

Optionally, vent gases flowing out of gas treatment unit 26 are further treated in a sulphur dioxide removal device 27. Sulphur dioxide removal device 27 removes most of the sulphur dioxide remaining in the vent gases after treatment in gas treatment unit 26. Sulphur dioxide removal device 27 may for example be a seawater scrubber, such as that disclosed in U.S. Pat. No. 5,484,535, a limestone wet scrubber, such as that disclosed in EP 0 162 536, or another such device that utilizes an alkaline absorption substance for removing sulphur dioxide from vent gases.

Optionally, vent gases flowing from gas treatment unit 26, or the sulphur dioxide removal device 27 as the case may be, pass through fluidly connected duct 34 to a carbon dioxide removal device 36, which removes at least some of the carbon dioxide from the vent gases. Carbon dioxide removal device 36 may be of any type suitable for removing carbon dioxide gas from vent gases. An example of a suitable carbon dioxide removal device 36 is that which is equipped for a chilled ammonia process. In a chilled ammonia process, vent gases are in contact with, for example, ammonium carbonate and/or ammonium bicarbonate solution or slurry at a low temperature, such as 0° to 10° C., in an absorber 38. The solution or slurry selectively absorbs carbon dioxide gas from the vent gases. Hence, cleaned vent gases, containing mainly nitrogen gas and oxygen gas, flow from absorber 38 though fluidly connected clean gas duct 40 and are released to the atmosphere via fluidly connected stack 42. The spent ammonium carbonate and/or ammonium bicarbonate solution or slurry is transported from absorber 38 to a regenerator 44 in which the ammonium carbonate and/or ammonium bicarbonate solution or slurry is heated to a temperature of, for example, 50° to 150° C. to cause a release of the carbon dioxide in concentrated gas form. The regenerated ammonium carbonate and/or ammonium bicarbonate solution or slurry is then returned to the absorber 38. The concentrated carbon dioxide gas flows from regenerator 44 via fluidly connected duct 46 to a gas processing unit 48 in which the concentrated carbon dioxide gas is compressed. The compressed concentrated carbon dioxide may be disposed of, for example by being pumped into an old mine or the like. An example of a carbon dioxide removal device 36 of the type described above is disclosed in US 2008/0072762. It will be appreciated that other carbon dioxide removal devices may also be utilized.

Figure 2:
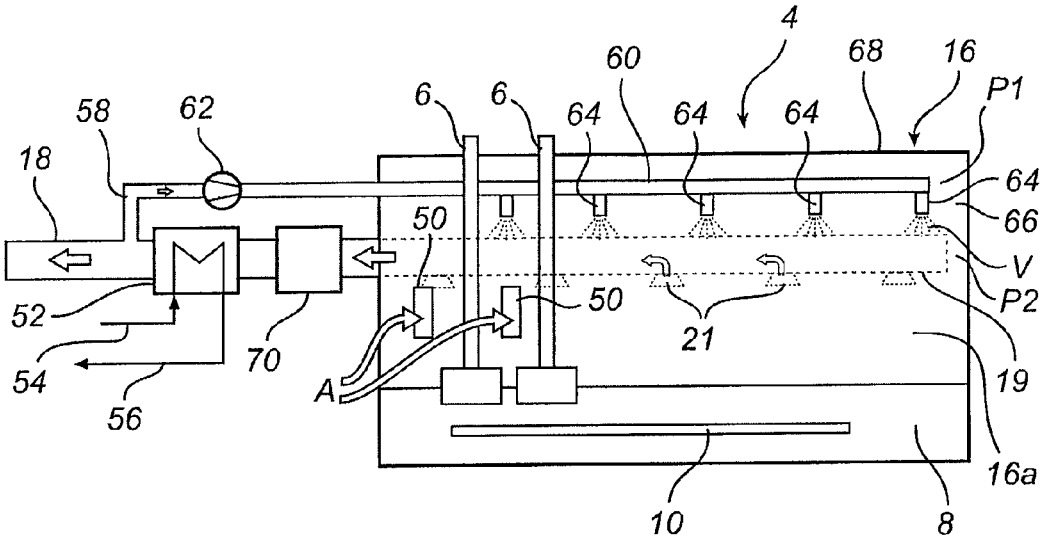
FIG. 2 is an enlarged schematic side view of an aluminium production electrolytic cell according to a first embodiment.

FIG. 2 is an enlarged schematic side view of the aluminium production electrolytic cell 4. For purposes of clarity, only two anode electrodes 6 are depicted in FIG. 2. As disclosed hereinbefore with reference to FIG. 1, fan 22 draws vent gases from interior area 16*a* of the hood 16 into fluidly connected suction duct 18. As a result of the suction created by fan 22, ambient air illustrated as "A" in FIG. 2, is sucked into interior area 16*a* via schematically illustrated non-gas-sealed gaps 50 occurring between side wall panels (not shown) and doors (not shown). Vent gases sucked from interior area 16*a* enter suction duct 18. Suction duct 18 may be fluidly connected to at least one, but more typically at least two, internal suction ducts 19. For purposes of clarity, only one internal suction duct 19 is depicted in FIG. 2. Internal suction duct 19 may have a number of slots or nozzles 21 to create an even draw of vent gases from interior area 16*a* into internal suction duct 19.

A heat exchanger 52 is arranged in duct 18 to be fluidly connected just downstream of internal suction duct 19. A cooling medium, which is normally a cooling fluid, such as a liquid or a gas, for example cooling water or cooling air, is supplied to heat exchanger 52 via supply pipe 54. The cooling medium could be forwarded from a cooling medium source, which may, for example, be ambient air, a lake or the sea, a water tank of a district heating system, etc. Hence, heat exchanger 52 may be a gas-liquid heat exchanger, if the cooling medium is a liquid, or a gas-gas heat exchanger if the cooling medium is a gas. The cooling medium could, for example, be circulated through heat exchanger 52 in a direction being counter-current, co-current, or cross-current with respect to the flow of vent gases passing therethrough. Often it is preferable to circulate the cooling medium through heat exchanger 52 counter-current to the vent gases to obtain the greatest heat transfer to the cooling medium prior to it exiting heat exchanger 52. Typically, cooling medium has a temperature of 40° to 100° C. In the event cooling medium is indoor air from cell room 2 illustrated in FIG. 1, the cooling medium will typically have a temperature about 10° C. above the temperature of ambient air. The vent gases drawn from interior area 16*a* via suction duct 18 may typically have a temperature of 90° to 200° C., but the temperature may also be as high as 300° C., or even higher. In heat exchanger 52, vent gases are cooled to a temperature of, typically, 70° to 130° C. As vent gases are cooled, the temperature of the cooling medium increases to, typically, 60° to 110° C., or even higher. Hence, heated cooling medium having a temperature of 60° to 110° C., or even up to 270° C. for example, leaves heat exchanger 52 via pipe 56. The cooling medium leaving via pipe 56 could be forwarded to a cooling medium recipient, for example, ambient air, a lake or the sea, a water tank of a district heating system, etc. Heated cooling medium may then be circulated to and utilized in other parts of the process, for example in regenerator 44, described hereinbefore with reference to FIG. 1. Heated cooling medium may also be utilized in other manners, such as for example, in the production of district heating water, in district cooling systems using hot water to drive absorption chillers, or as a heat source for desalination plants as described in patent application WO 2008/113496.

A return duct 58 is fluidly connected to suction duct 18 downstream of heat exchanger 52. The return duct 58 may circulate cooled vent gases into one end of electrolytic cell 4 or may circulate cooled vent gases to supply duct 60 which is arranged inside interior area 16*a*. Return gas fan 62 circulates cooled vent gases back to electrolytic cell 4 and supply duct 60. Duct 60 has nozzles 64 to distribute cooled vent gases, indicated as "V" in FIG. 2, in interior area 16*a*. Internal suction duct 19 may be positioned in the same horizontal plane, P1, as supply duct 60, or as depicted in FIG. 2, in a different horizontal plane, P2. Internal suction duct 19 could also be more or less integrated with duct 60, for example, in the form of a double-walled duct.

Nozzles 64 of duct 60 are, as depicted in FIG. 2, located in an upper portion 66 of interior area 16*a*. Ambient air A entering interior area 16*a* via gaps 50, sweeps over bath 8 and anodes 6, and is thus heated. Heated ambient air moves vertically upward, toward roof 68 of hood 16. Equipment within electrolytic cell 4, especially that located in upper portion 66 of interior area 16*a*, requires protection from exposure to very hot vent gases. To obtain safe operation and long service life of such equipment, temperatures in upper portion 66 of interior area 16*a* should preferably be less than about 200° C. to 250° C. to avoid or minimize too high of equipment heat loads. Furthermore, the effluent gases generated in the aluminium production process are hot and tend to accumulate under roof 68 of hood 16. With very high temperatures at roof 68, the risk of leakage of such accumulated effluent gases increases. By supplying cooled vent gases via nozzles 64 to upper portion 66, vent gases in upper portion 66 are cooled. Such cooling reduces the risks of equipment failure within electrolytic cell 4 due to excessive temperatures and leakage of accumulated hot effluent gases.

Cooled vent gases released in upper portion 66 tend to create a vent gas temperature gradient within electrolytic cell 4. This temperature gradient has lower temperatures at upper portion 66 and increasing temperatures towards the aluminium oxide feeding points at the lower portion of the cell 4 where aluminium oxide feeder 14, illustrated in FIG. 1, supplies powdered aluminium oxide to bath 8. Such a temperature gradient is beneficial for the life of the equipment within electrolytic cell 4 and differs significantly from methods and devices of the prior art where temperatures are higher at the top of the electrolytic cell.

Cooled vent gases cool interior area 16*a*. Cooled vent gases replace some of ambient indoor air. Hence, the ambient indoor air drawn into interior area 16*a* via gaps 50 is less compared to that of prior art cells. Still further, the circulation of a portion of the vent gases from interior area 16*a* back to interior area 16*a* as cooled vent gases results in an increased concentration of effluent gases, such as hydrogen fluoride, sulphur dioxide, carbon dioxide, and dust particles, in the vent gases. Typically, about 10% to about 80% of a total quantity of vent gases drawn from interior area 16*a* are circulated back to interior area 16*a* after being cooled in the heat exchanger 52. As a consequence, the total flow of vent gases cleaned in gas treatment unit 26 is reduced compared to that of the prior art method. Such is an advantage since gas treatment unit 26 thus has lower capacity requirements measured in $m^3/h$ of vent gases, thereby reducing the capital investment and ongoing operating costs of gas treatment unit 26. Another advantage of reducing the amount of ambient indoor air drawn into interior area 16*a* is the reduction in the quantity of moisture transported through the gas treatment unit 26. Such moisture originates mainly from moisture in the ambient air. The quantity of moisture, measured in kg/h, carried through gas treatment unit 26 has a large influence on the formation of hard grade scale and crust on unit components, such as reactors and filters, in contact with vent gases. By reducing the quantity of moisture carried through gas treatment unit 26, maintenance and operating costs associated with scale and crust formation within gas treatment unit 26 may, hence, be reduced. Still further, optional carbon dioxide removal device 36 can also be of a lower capacity design based on the smaller vent gas flow thus decreasing costs associated therewith. Gas treatment unit 26 is useful in cleaning vent gases having relatively high concentrations of hydrogen fluoride gas and sulphur dioxide gas. Higher concentrations of such gases makes the cleaning process of the gas treatment unit 26 more efficient. This is also true of carbon dioxide removal device 36. Carbon dioxide removal device 36 is useful in treating vent gases having relatively high concentration of carbon dioxide, thus making absorber 38 work more efficiently.

Optionally, a dust removal device 70 may be positioned within the suction duct 18 upstream of heat exchanger 52. Dust removal device 70 may, for example, be a fabric filter, a cyclone or a similar dust removal device useful in removing at least a portion of the dust particles entrained with the vent gases, before vent gases flow into heat exchanger 52. The dust removal device 70 reduces the risk of dust particles clogging heat exchanger 52, and also reduces the risk of abrasion caused by dust particles in heat exchanger 52, fan 62, ducts 18, 58, 60, and nozzles 64.

Figure 3:
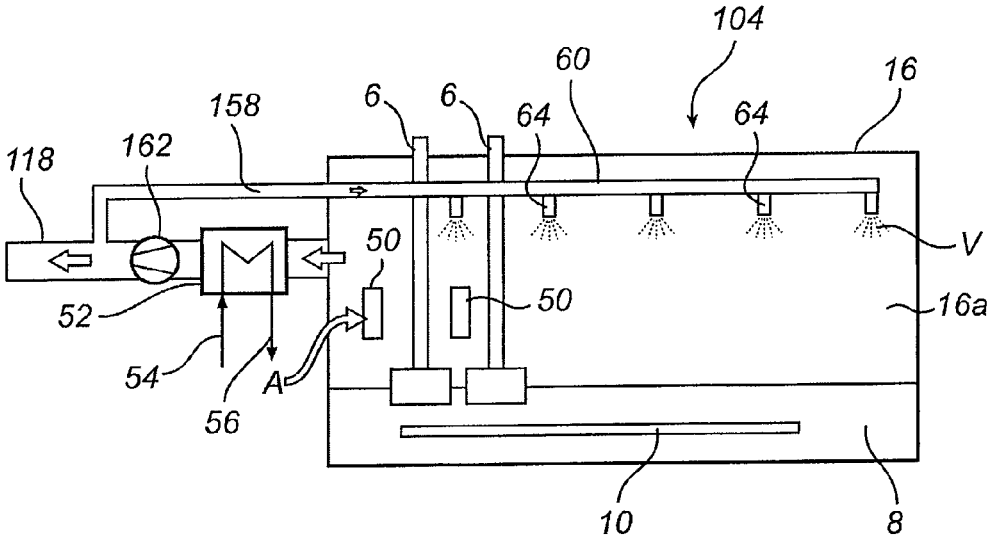
FIG. 3 is a schematic side view of an aluminium production electrolytic cell according to a second embodiment.

FIG. 3 is a schematic side view of aluminium production electrolytic cell 104 according to a second embodiment. Many of the features of the electrolytic cell 104 are similar to the features of the electrolytic cell 4, and those features have been given the same reference numerals. A suction duct 118 is fluidly connected to interior area 16*a* via hood 16 to draw vent gases from interior area 16*a*. Heat exchanger 52 is arranged within duct 118 just downstream of hood 16. A cooling medium, such as cooling water or cooling air, is supplied to heat exchanger 52 via supply pipe 54, to cool vent gases in a similar manner as disclosed hereinbefore with reference to FIG. 2. Returning to FIG. 3, spent cooling medium exits heat exchanger 52 via pipe 56.

Vent gas fan 162 is arranged within duct 118 downstream of heat exchanger 52. Fan 162 circulates vent gases from interior area 16*a* to gas treatment unit 26 via duct 118, collecting duct 20 and suction duct 24 described hereinbefore with reference to FIG. 1. Hence, fan 162 assists fan 22, depicted in FIG. 1, in circulating vent gases from interior area 16*a* to gas treatment unit 26.

A return duct 158 is fluidly connected to duct 118 downstream of fan 162. Duct 158 is fluidly connected to duct 60 arranged inside interior area 16*a*. Fan 162 circulates vent gases cooled in heat exchanger 52, to duct 158 and duct 60, equipped with nozzles 64 to distribute cooled vent gases V inside interior area 16*a*.

In comparison to electrolytic cell 4 described in FIG. 2, fan 162 of electrolytic cell 104 provides the dual function of assisting fan 22 in transporting vent gases to gas treatment unit 26 and circulating a portion of the cooled vent gases back to interior area 16*a* to reduce the draw of ambient air and to increase pollutant concentrations in the vent gases eventually treated in gas treatment unit 26 and carbon dioxide removal device 36.

Figure 4:
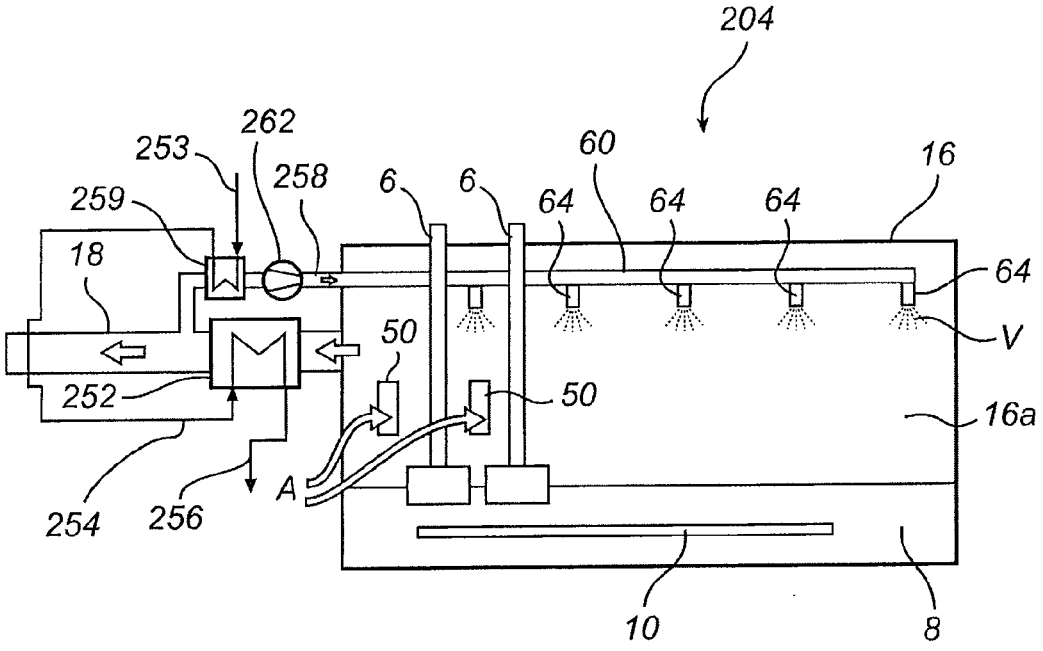
FIG. 4 is a schematic side view of an aluminium production electrolytic cell according to a third embodiment.

FIG. 4 is a schematic side view of aluminium production electrolytic cell 204 according to a third embodiment. Many of the features of the electrolytic cell 204 are similar to the features of the electrolytic cell 4, and those features have been given the same reference numerals. Suction duct 18 is fluidly connected to interior area 16*a* via hood 16. A first heat exchanger 252 is arranged in duct 18 just downstream of hood 16. Return duct 258 is fluidly connected to duct 18 downstream of first heat exchanger 252. A second heat exchanger 259 is arranged in duct 258.

A cooling medium in the form of a cooling fluid, such as cooling water or cooling air, is supplied to second heat exchanger 259 via a first pipe 253. Partially spent cooling fluid exits second heat exchanger 259 via a second pipe 254. Pipe 254 carries the partially spent cooling fluid to first heat exchanger 252. Spent cooling fluid exits first heat exchanger 252 via a third pipe 256.

Duct 258 is fluidly connected to supply duct 60, which is arranged inside interior area 16*a*. Return gas fan 262 arranged in duct 258 downstream of second heat exchanger 259, circulates vent gases, cooled in first and second heat exchangers 252, 259, to duct 60. Duct 60 is equipped with nozzles 64 to distribute cooled vent gases, depicted as "V" in FIG. 4, in interior area 16*a*.

Hence, in electrolytic cell 204, a portion of the vent gases drawn from interior area 16*a* are cooled and circulated back to interior area 16*a*. The cooled vent gases are cooled in two stages, firstly in the first heat exchanger 252, and secondly in the second heat exchanger 259. Typically the cooling fluid supplied via pipe 253 to second heat exchanger 259 may have a temperature of about 40° to about 80° C. The partly spent cooling fluid that exits second heat exchanger 259 via pipe 254 may typically have a temperature of about 60° to about 100° C. The spent cooling fluid that exits first heat exchanger 252 via pipe 256 may typically have a temperature of about 80° to about 180° C., or even as high as 270° C., or even higher. Vent gases drawn from interior area 16*a* via duct 18 typically have a temperature of about 90° to about 200° C., or even higher. In first heat exchanger 252 vent gases are cooled to a temperature of, typically, about 70° to about 130° C. Cooled vent gases circulated via duct 258 to interior area 16*a* are typically cooled further, in second heat exchanger 259, to a temperature of typically about 50° to about 110° C.

In comparison to the electrolytic cell 4 disclosed hereinbefore with reference to FIG. 2, electrolytic cell 204 increases heat transfer to the cooling fluid, since heat exchangers 252, 259 are positioned in series with respect to cooling fluid flow and vent gases flow, and the cooling fluid and the vent gases to be cooled flow counter-current with respect to one another. Increased heat transfer to cooling fluid increases the value of the cooling fluid. Furthermore, the fact that the cooled vent gases are cooled to a lower temperature, compared to the embodiment described hereinbefore with reference to FIG. 2, makes it possible to replace a larger portion of the ambient indoor air, which may have, for example, a temperature of 30° C., with circulated cooled vent gases, having for example a temperature of 80° C., and still achieve a sufficiently low temperature in the interior area 16*a*. Circulation and use of cooled vent gases rather than use of added, diluting, ambient air leads to a lower flow of vent gases to be cleaned by gas treatment unit 26 and carbon dioxide removal device 36, resulting in decreased equipment capacity requirements and investment costs.

As an alternative to arranging two heat exchangers 252, 259, in series with respect to the flow of the cooling fluid and cooled vent gases, two heat exchangers, 252, 259, could each operate independently of each other with respect to the cooling fluid. Each heat exchanger could even operate with a different type of cooling fluid.

An alternative to arranging two heat exchangers 252, 259, to cool vent gases is to utilize only one heat exchanger. Hence, an electrolytic cell 204 is provided with only first heat exchanger 252, positioned within the system for uses similar to those of electrolytic cell 4. Likewise, only second heat exchanger 259 could be used in the place of second heat exchanger 252. In the latter case, only the portion of vent gases to be circulated back to internal area 16*a* are cooled.

Figure 5:
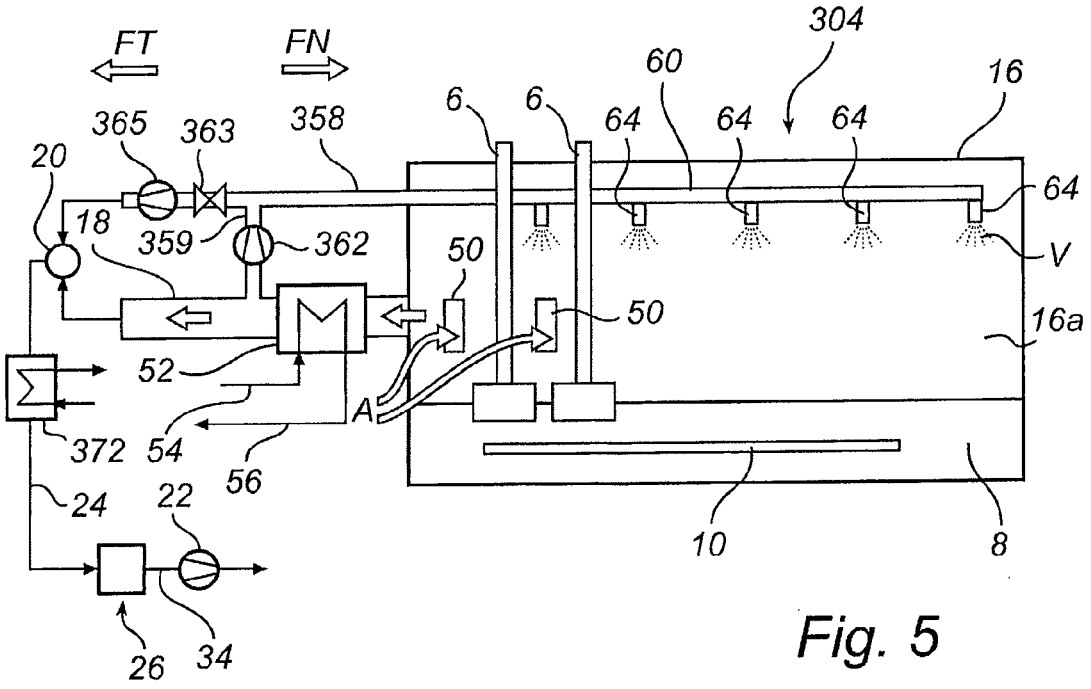
FIG. 5 is a schematic side view of an aluminium production electrolytic cell according to a fourth embodiment.

FIG. 5 is a schematic side view of aluminium production electrolytic cell 304 according to a fourth embodiment. Many of the features of electrolytic cell 304 are similar to the features of electrolytic cell 4, and those features have been given the same reference numerals. Suction duct 18 is fluidly connected to interior area 16*a* via hood 16 for drawing vent gases from interior area 16*a*. A heat exchanger 52 is arranged in duct 18 just downstream of hood 16. A cooling medium, such as cooling water or cooling air, is supplied to heat exchanger 52 via supply pipe 54, to cool the vent gases in a similar manner as that disclosed hereinbefore with reference to FIG. 2. Returning to FIG. 5, cooling medium exits heat exchanger 52 via a pipe 56.

Gas duct 359 is fluidly connected to duct 18 downstream of heat exchanger 52. Return gas fan 362 circulates a portion of the cooled vent gases from duct 18 to duct 359. Duct 359 is fluidly connected to a combined tending and return duct 358. As illustrated in FIG. 5, the combined tending and return duct 358 is, at the right side of the connection to duct 359, fluidly connected to supply duct 60 positioned within interior area 16*a*. At the left side of the connection to the gas duct 359 the combined tending and return duct 358 is equipped with a damper 363 and a tending gas fan 365. Under normal operating conditions, damper 363 is closed and fan 365 is not functioning. In this case, fan 362 circulates vent gases cooled in heat exchanger 52 to duct 358. Since in this case damper 363 is closed, cooled vent gases circulate to duct 60 equipped with nozzles 64 to distribute cooled vent gases V inside interior area 16*a*, as described hereinbefore with reference to FIG. 2.

Returning to FIG. 5, electrolytic cell 304 is switched from normal operating conditions or mode as described hereinabove, to a tending operating mode, i.e., a mode in which, for example, one or more consumed anode electrodes 6 are to be replaced with new ones. In the tending operating mode, fan 362 is not functioning, damper 363 is open, and fan 365 is functioning. Fan 365 draws ambient air from interior area 16*a* via duct 60 and nozzles 64. Hence, in the tending operating mode, duct 358 is utilized for cooling and increasing the ventilation in interior area 16*a*. In this process, high gas and dust particle emissions from the cell during tending activities, are drawn with duct 60 to improve the working environment for operators performing the tending, e.g., the replacement of consumed anode electrodes 6. Typically, the air flow from interior area 16*a* in the tending operating mode, via ducts 60 and 358, is two to four times greater than that of the vent gases drawn from interior area 16*a* in the normal operating mode. Thus, duct 358 is utilized for circulating a portion of the cooled vent gases to interior area 16*a* in normal operating mode, and is utilized for cooling and increasing the ventilation of interior area 16*a* in the tending operating mode. In FIG. 5, the direction of gas flow in duct 358 in normal operating mode is depicted by arrow FN and in the tending operating mode is depicted by arrow FT.

Ducts 358 and 18 will typically be fluidly connected to duct 24, via collecting duct 20, for treatment of high gas and dust particle emissions from electrolytic cells in tending operating mode, along with treatment of vent gases from electrolytic cells in normal operating mode in gas treatment unit 26.

The draw created in duct 358 by means of fan 22, arranged in duct 34 downstream of gas treatment unit 26, may be sufficient to draw a certain flow of vent gases through duct 358 also without the use of fan 365 when damper 363 is open. There is a pressure drop in heat exchanger 52 and there is a pressure drop in fluidly connected duct 18. A typical pressure drop in heat exchanger 52 and duct 18 would be about 500 Pa to about 1000 Pa, which is similar to, or larger than the pressure drop in duct 358, being parallel to duct 18. Such pressure drop in heat exchanger 52 and duct 18 would cause a flow of tending gases through the duct 358, in the tending mode when the damper 363 is open and also in the absence of the tending gas fan 365, that would typically correspond to a gas flow of the same rate or double that of the flow of vent gases in duct 18 in such tending mode.

As an option, a further heat exchanger 372 is arranged in duct 24. Heat exchanger 372 provides further cooling of the vent gases circulated to gas treatment unit 26. Further cooling of the vent gases by heat exchanger 372 provides for a further reduction in equipment size and capacity requirements of gas treatment unit 26. A cooling medium, such as ambient air or cooling water, is circulated through further heat exchanger 372. Optionally, the cooling medium of heat exchanger 372 may be circulated also through heat exchanger 52 in a counter-current relation to that of the vent gases.

Figure 6:
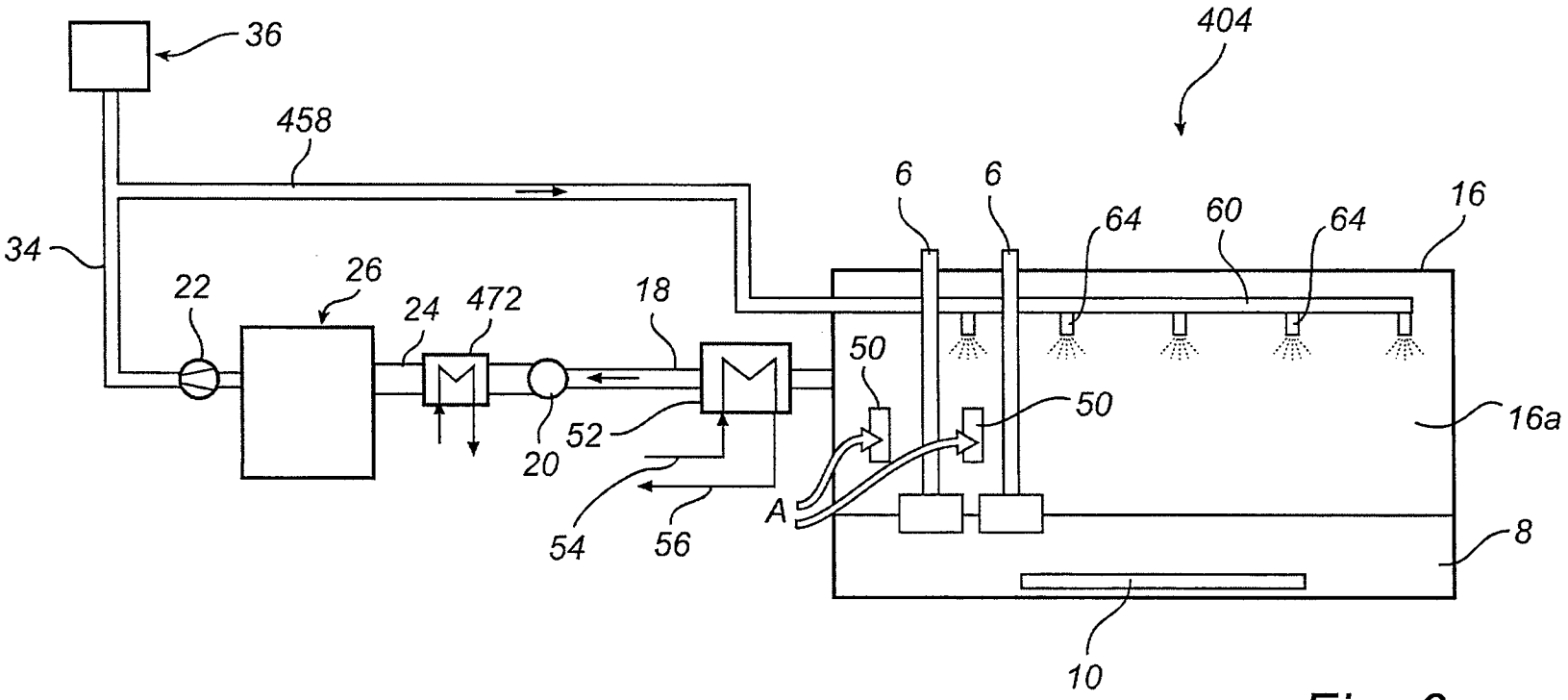
FIG. 6 is a schematic side view of an aluminium production electrolytic cell according to a fifth embodiment.

FIG. 6 is a schematic side view of aluminium production electrolytic cell 404 according to a fifth embodiment. Many features of electrolytic cell 404 are similar to the features of aluminium production electrolytic cell 4, and those features have been given the same reference numerals. Suction duct 18 is fluidly connected to interior area 16*a* for passage of vent gases from interior area 16*a*. A heat exchanger 52 is arranged in duct 18 just downstream of interior area 16*a*. A cooling medium, such as cooling water or cooling air, is supplied to heat exchanger 52 via supply pipe 54, to cool vent gases in a similar manner as that disclosed hereinbefore with reference to FIG. 2. Returning to FIG. 6, cooling medium exits heat exchanger 52 via pipe 56.

In electrolytic cell 404 the entire flow of vent gases are drawn from interior area 16*a*, by fan 22 via duct 18, collecting duct 20, gas suction duct 24 and gas treatment unit 26. Duct 20, duct 24, and gas treatment unit 26 are all of the same type described hereinbefore with reference to FIG. 1. In gas treatment unit 26, hydrogen fluoride, sulphur dioxide and dust particles are at least partially removed from the vent gases. Hence, rather clean vent gases, still containing carbon dioxide, are drawn from gas treatment unit 26 and enter fan 22 positioned downstream of the gas treatment unit 26. Fan 22 circulates the vent gases through duct 34 to a carbon dioxide removal device 36, which may be of the same type as described hereinbefore with reference to FIG. 1. As an alternative, fan 22 may circulate the vent gases to another gas treatment unit, for example a sulphur dioxide removal device 27 of the type depicted in FIG. 1, or to a stack.

Return duct 458 is fluidly connected to duct 34 downstream of fan 22, i.e. duct 458 is fluidly connected to duct 34 between fan 22 and carbon dioxide removal device 36. Duct 458 is likewise fluidly connected to supply duct 60 arranged inside interior area 16*a*. Fan 22 hence circulates vent gases cooled in heat exchanger 52 and cleaned in gas treatment unit 26, to duct 458 and duct 60 equipped with nozzles 64 to distribute the cooled vent gases V inside interior area 16*a*.

In comparison to aluminium production electrolytic cell 4 described hereinbefore with reference to FIG. 2, aluminium production electrolytic cell 404 utilizes circulated vent gases that have been cleaned in gas treatment unit 26. Hence, the cooled vent gases circulated into interior area 16*a* of electrolytic cell 404 contain a low concentration of dust particles and effluent gases, such as hydrogen fluoride and sulphur dioxide. This at times is an advantage since the use of cleaned cooled vent gases may decrease the risk of equipment corrosion, erosion, scale formation, etc. occurring. The use of cleaned cooled vent gases also improves the overall working environment. Since duct 458 returning cooled vent gases to interior area 16*a* is arranged upstream of carbon dioxide removal device 36, the concentration of carbon dioxide in the vent gases transported to carbon dioxide removal device 36 is higher than that of a prior art process in which no circulation of cooled vent gases is made.

As an option, a further heat exchanger 472 may be arranged in duct 24. Heat exchanger 472 provides further cooling of vent gases circulated to gas treatment unit 26. Further cooling of the vent gases by heat exchanger 472 provides for a further reduction in equipment size and capacity requirements of gas treatment unit 26. Furthermore, the cooled vent gases to be circulated to interior area 16*a* via duct 458 are further cooled by means of further heat exchanger 472, resulting in a lower temperature in interior area 16*a*, compared to utilizing only heat exchanger 52. A cooling medium, such as ambient air or cooling water, is circulated through further heat exchanger 472. Optionally, the cooling medium of heat exchanger 472 may be circulated also through heat exchanger 52 in a counter-current relation to that of the vent gases. Still further, heat exchanger 472 may even be used to replace heat exchanger 52, since the vent gases to be circulated to interior area 16*a* flow from duct 34 via duct 458 arranged downstream of heat exchanger 472. Also, in the event that further heat exchanger 472 is the only heat exchanger, vent gases to be circulated to interior area 16*a* may still be cooled.

As a further option, the vent gases passing through duct 458 may be further cooled by a yet further heat exchanger, not illustrated for reasons of maintaining clarity of illustration, arranged in duct 458, or, as a further option, arranged in duct 34 upstream of the connection to duct 458.

Figure 7:
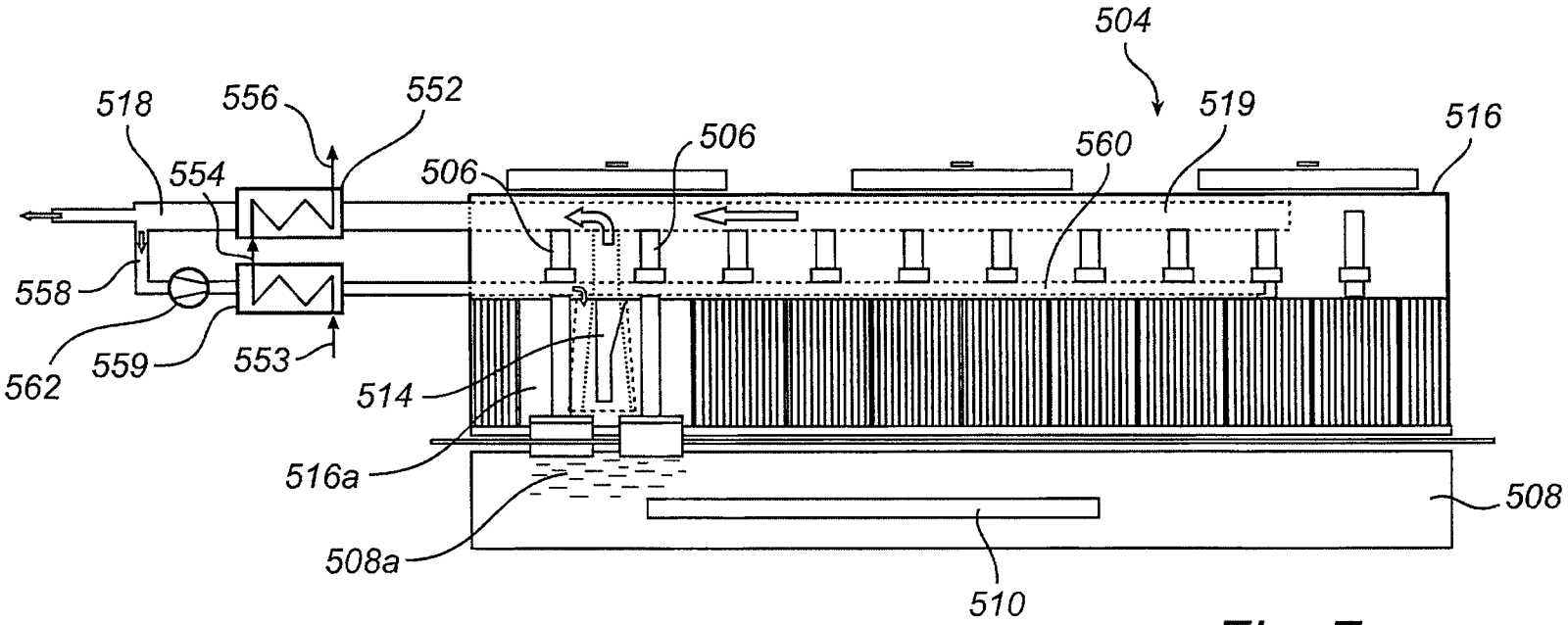
FIG. 7 is a schematic side view of an aluminium production electrolytic cell according to a sixth embodiment.

FIG. 7 illustrates aluminium production electrolytic cell 504 according to a sixth embodiment. A hood 516 is arranged over at least a portion of bath 508 creating interior area 516*a*. Suction duct 518 is fluidly connected to interior area 516*a* via hood 516. A fan, not depicted in FIG. 7 for reasons of simplicity and clarity, draws vent gases from duct 518 to a gas treatment unit (not shown) as disclosed hereinbefore with reference to FIG. 1. Electrolytic cell 504 comprises a number of anode electrodes 506, typically six to thirty anode electrodes, typically located in two parallel rows arranged along the length of cell 504. Electrolytic cell 504 further comprises typically 3 to 5 aluminium oxide containing hoppers described in more detail hereinafter with reference to FIG. 8*a*, and the same number of aluminium oxide feeders 514 arranged along the length of electrolytic cell 504. Anode electrodes 506 extend into contents 508*a* of bath 508. One or more cathode electrodes 510 are located in contents 508*a* of bath 508. For reasons of simplicity and clarity of FIG. 7, only two anode electrodes 506 are depicted therein.

A first heat exchanger 552 is arranged in duct 518 just downstream of hood 516. Return duct 558 is fluidly connected to duct 518 downstream of first heat exchanger 552. A second heat exchanger 559 is arranged in duct 558. Duct 558 is fluidly connected to supply duct 560 arranged inside interior area 516*a* of hood 516. A return gas fan 562 may be arranged in duct 558 upstream or downstream of second heat exchanger 559, to circulate cooled vent gases, cooled by first and second heat exchangers 552, 559, to duct 560.

A cooling medium, typically a cooling fluid, such as cooling water or cooling air, is supplied to second heat exchanger 559 via pipe 553. Cooling fluid exits second heat exchanger 559 via pipe 554. Pipe 554 allows the cooling fluid to flow to first heat exchanger 552. Cooling fluid exits first heat exchanger 552 via pipe 556.

As with electrolytic cell 304 described hereinbefore with reference to FIG. 4, as alternative to arranging the first and second heat exchangers 552, 559, in a series, it would also be possible to arrange the heat exchangers in parallel to each other with respect to the transport of the cooling fluid. The heat exchangers 552, 559, may also utilize different cooling fluids. An alternative to arranging two heat exchangers 552, 559 to cool vent gases circulated to interior area 516*a*, is to utilize only one heat exchanger 552 or 559. Hence, an electrolytic cell 504 may be equipped with only first heat exchanger 552, which would result in a heat exchanger arrangement similar to that used with electrolytic cell 4 depicted in FIG. 2, or with only second heat exchanger 559. In the latter case, only that portion of vent gases circulated to interior area 516*a* is cooled.

Duct 518 is fluidly connected to a collecting duct 519 located inside interior area 516*a*. In FIG. 7, only one aluminium oxide feeder 514 is depicted for the purpose of maintaining clarity of the illustration. Feeder 514 is equipped to draw vent gases from interior area 516*a*. Such vent gases, which may contain hydrogen fluoride, sulphur dioxide, carbon dioxide and aluminium oxide particulate material generated in the feeding of aluminium oxide to bath 508 of electrolytic cell 504, are circulated to fluidly connected duct 519 and fluidly connected duct 518. Cooled vent gases are supplied to feeder 514 from fluidly connected duct 560 as described in more detail hereinafter.

Figure 8A:
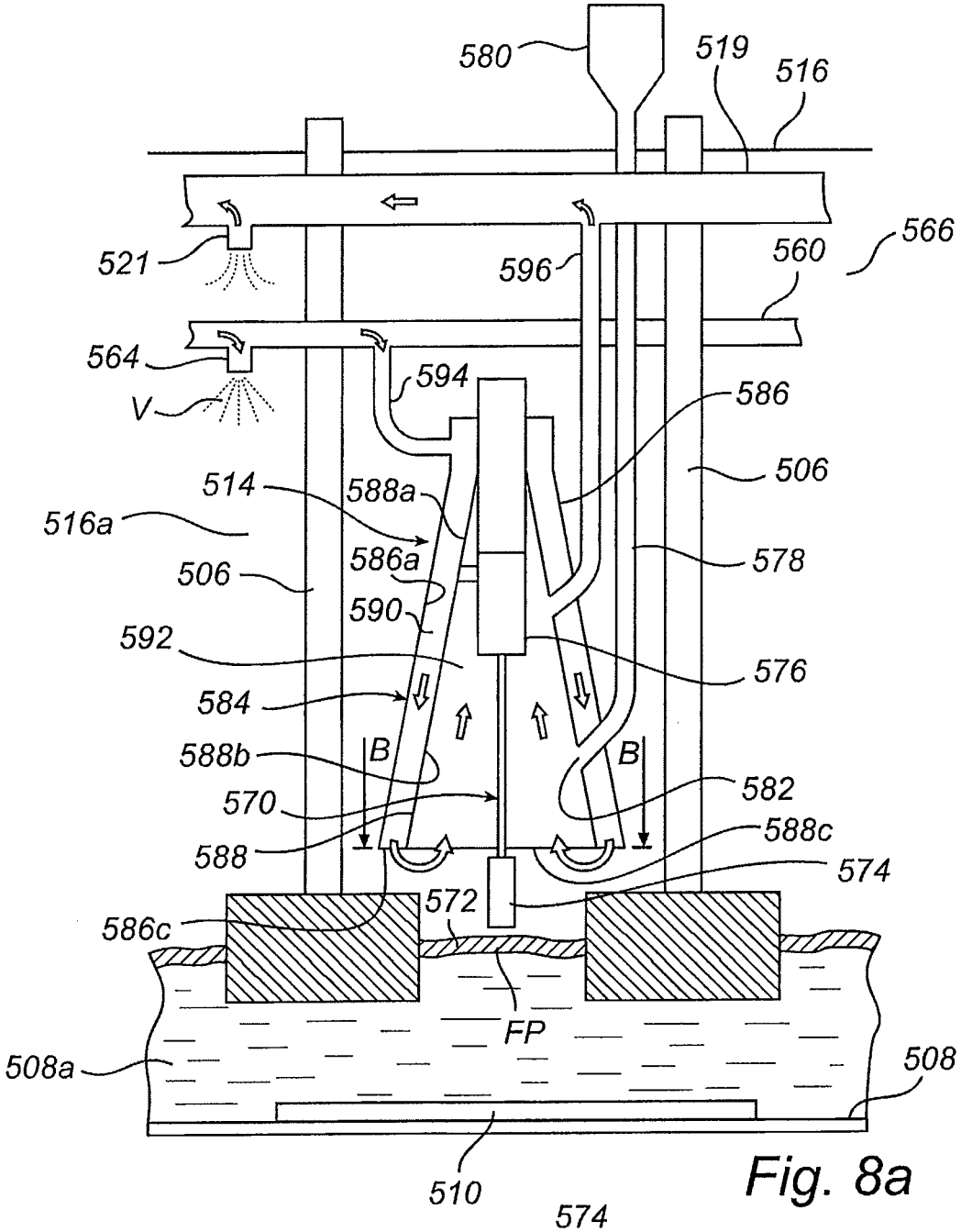
FIG. 8*a* is an enlarged schematic side view of an aluminium oxide feeder of the aluminium production electrolytic cell of FIG. 7.
Figure 8B:
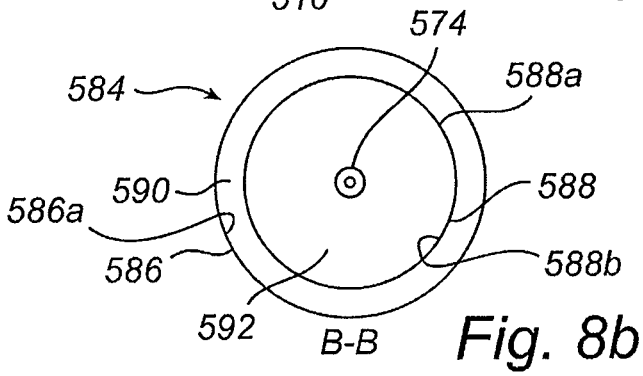
FIG. 8*b* is a cross-sectional view of the aluminium oxide feeder of FIG. 8*a* taken along line B-B.

FIGS. 8*a* and 8*b* illustrate aluminium oxide feeder 514 of aluminium production electrolytic cell 504 in more detail. FIG. 8*a* is a vertical cross sectional view of feeder 514, and FIG. 8*b* illustrates a cross section of feeder 514 taken along fine B-B of FIG. 8*a*.

Feeder 514 comprises a centrally arranged crust breaker 570 utilized for breaking crust 572 that forms on the surface of the smelted aluminium contents 508*a* within bath 508. Crust breaker 570 comprises a hammer portion 574 utilized for penetrating crust 572 and a piston portion 576 utilized for pushing hammer portion 574 through crust 572.

Feeder 514 further comprises an aluminium oxide feeder pipe 578. Pipe 578 is utilized for the passage of aluminium oxide powder from aluminium oxide hopper 580 to bath 508 at a feeding position, denoted FP in FIG. 8*a*. The desired feeding position is that area located between two anode electrodes 506 just after crust breaker 570 has formed an opening in crust 572. To this end, pipe 578 has a feed port 582 positioned adjacent to hammer portion 574, such that a controlled and metered amount of aluminium oxide powder may be dropped directly into an opening formed in crust 572 by hammer portion 574.

Feeder 514 comprises a double-walled cover 584 having an outer wall 586 and an inner wall 588. A first space 590 is formed between the interior surface 586*a* of outer wall 586 and the exterior surface 588*a* of inner wall 588, as best depicted in FIG. 8*b*. Inner wall 588, generally parallels the shape of outer wall 586. The interior surface 588*b* of inner wall 588 defines a second space 592. Space 590, as is best depicted in FIG. 8*a*, is fluidly connected via duct 594 to duct 560. Space 592 is fluidly connected via a vent duct 596, to duct 519. Fan 562, depicted in FIG. 7, circulates cooled vent gases to duct 560 via duct 558. Outer wall 586 and inner wall 588 both have open lower ends 586*c* and 588*c*, respectively.

As depicted in FIG. 8*a* by arrows, returned cooled vent gases flow through duct 560 and duct 594 to space 590. Optionally, duct 560 may be equipped with nozzles 564. Such a nozzle 564 is shown in FIG. 8*a*, useful to circulate cooled vent gases, indicated as "V" in FIG. 8*a*, in interior area 516*a*. Hence, the cooled vent gases may be circulated to both feeder 514 via duct 594, and to interior area 516*a* via nozzles 564.

Cooled vent gases circulated via duct 594, to space 590 flows downward through space 590 to form a "curtain" of cooled vent gases around area FP where crust breaker 570 operates and where the aluminium oxide is supplied from feed port 582 of pipe 578 to bath 508. The cooled vent gases entrain effluent gases and dust particles that may include aluminium oxide particles, and is drawn into space 592. As depicted by arrows in FIG. 8*a*, the cooled vent gases with the entrained effluent gases and dust particles will make a "U-turn" after space 590 and flow substantially vertically upwards through space 592. From space 592, vent gases are drawn through duct 596 and duct 519 out of interior area 516*a*. Optionally, duct 519 may comprise a number of nozzles 521 through which vent gases in upper portion 566 of interior area 516*a* may be drawn into duct 519.

Hence, as depicted in FIGS. 7, 8*a* and 8*b*, cooled vent gases from duct 518 and circulated in interior area 516*a* via duct 560 may be used both generally to cool interior area 516*a*, and specifically such as with feeder 514. It will be appreciated that, as an alternative to the embodiment depicted in FIGS. 7, 8*a* and 8*b*, it would be possible to circulate cooled vent gases solely to specific points of suction, such as feeder 514. Furthermore, it will be appreciated that FIG. 7 illustrates one example of how vent gases may be cooled and circulated to interior area 516*a*. It will be appreciated that the examples provided herein of heat exchanger arrangements and fluidly connected ductwork for circulating vent gases as disclosed through the descriptions of FIGS. 2-6, may be applied to electrolytic cell 504 as well. Hence, electrolytic cell 504 could, as an alternative, be provided with only one heat exchanger, in a similar arrangement as heat exchanger 52 described hereinbefore with reference to FIGS. 2, 3, 5 and 6. Furthermore, the cooled vent gases for electrolytic cell 504, may as an alternative, be collected downstream of gas treatment unit 26, in a manner similar to that described hereinbefore with reference to FIG. 6.

Electrolytic cell 504 depicted in FIGS. 7, 8*a* and 8*b*, as a further option, may be equipped for a tending operating mode of a similar design as that depicted in FIG. 5. Hence, in the tending operating mode, vent gases would be drawn from interior area 516*a* via duct 519 and, simultaneously, via duct 560.

It will be appreciated that numerous variants of the embodiments described above are possible within the scope of the appended claims.

Hereinbefore it has been described that cooled vent gases are returned to interior area 16*a*, 516*a* from suction duct 18, 518, as depicted in FIGS. 2-5 and 7, or from duct 34, as depicted in FIG. 6. It will be appreciated that cooled vent gases may, as alternative, be returned to interior area 16*a*, 516*a* from collecting duct 20, from suction duct 24, or from any other ductwork through which cooled vent gases flow.

Hereinbefore it has been described, with reference to FIGS. 5 and 6, that further heat exchanger 372, 472 may be arranged in duct 24 to cause further cooling of the vent gases prior to entering gas treatment unit 26. It will be appreciated that one or more further heat exchangers may be arranged in duct 24, or duct 20, or a corresponding duct. Such is also true for the embodiments illustrated in FIGS. 1-4 and FIGS. 7, 8*a* and 8*b*.

Hereinbefore it has been described, with reference to FIGS. 2-5 and 7, that vent gases from interior area 16*a* of one aluminium production electrolytic cell 4, 104, 204, 304, 504 are cooled and then returned to the interior area 16*a* of that same cell. It will be appreciated that it is also possible to circulate cooled vent gases from interior area of one aluminium production electrolytic cell to an interior area of another aluminium production electrolytic cell. It is also possible to circulate cooled vent gases from interior area of one cell to respective interior areas of several other cells.

To summarize, aluminium production electrolytic cell 4 comprises a bath 8 with contents 8*a*, at least one cathode electrode 10 in contact with contents 8*a*, at least one anode electrode 6 in contact with contents 8*a*, and a hood 16, defining interior area 16*a*, covering at least a portion of said bath 8. A suction duct 18 is fluidly connected to interior area 16*a* for removing vent gases from interior area 16*a*. Electrolytic cell 4 comprises at least one heat exchanger 52 for cooling at least a portion of the vent gases drawn from interior area 16*a* via duct 18, and at least one return duct 58 for circulation of at least a portion of the cooled vent gases, cooled by heat exchanger 52, to interior area 16*a*.

While the present invention has been described with reference to a number of preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. A method of ventilating an aluminium production electrolytic cell comprising a bath with contents, at least one cathode electrode in contact with said contents, at least one anode electrode in contact with said contents, and a hood, defining an interior area covering at least a portion of said bath, the method comprising:

drawing vent gases from said interior area through a cover interior area defined by a double-walled cover of an aluminium oxide feeder with each a crust breaker and a feeder pipe arranged within the cover interior area of the aluminium oxide feeder;

cooling a full flow of vent gases drawn from the interior area using a first heat exchanger to produce cooled vent gases;

drawing a portion of the cooled vent gases;

circulating the drawn portion of the cooled vent gases to a second heat exchanger for further cooling to produce further cooled vent gases; and circulating at least a portion of the further cooled vent gases to the interior area via a passage formed between double walls of the double-walled cover, for a flow of at least a portion of said further cooled vent gases from between the double walls and into the interior area to form a curtain of further cooled vent gases around the feeder pipe from where aluminium oxide powder is supplied to the bath.

2. The method according to claim 1, further comprising:

circulating 10% to 80% of a total quantity of the vent gases drawn from the interior area back to interior area after cooling at least a portion of the vent gases.

3. A method according to claim 1, wherein a cooling fluid is first passed through the second heat exchanger, and then passed through the first heat exchanger.

4. A method according to claim 1, wherein said cooled vent gases or said further cooled vent gases first circulate through a gas treatment unit to remove at least some hydrogen fluoride gas of the vent gases before circulation to the interior area.

5. The method according to claim 1, wherein at least a portion of said cooled vent gases or said further cooled vent gases is circulated to an upper portion of the interior area.

6. The method according to claim 1, wherein at least a portion of dust particles entrained by vent gases drawn from the interior area are removed from said vent gases prior to cooling said vent gases.

7. A method of ventilating an aluminium production electrolytic cell comprising a bath with contents, at least one cathode electrode in contact with said contents, at least one anode electrode in contact with said contents, and a hood, defining an interior area covering at least a portion of said bath, the method comprising:

drawing vent gases from said interior area through a cover interior area defined by a double-walled cover of an aluminium oxide feeder with each a crust breaker and a feeder pipe arranged within the cover interior area of the aluminium oxide feeder;

cooling a full flow of vent gases drawn from the interior area using a first heat exchanger to produce cooled vent gases;

drawing a portion of the cooled vent gases;

circulating the drawn portion of the cooled vent gases to a second heat exchanger for further cooling;

further cooling the drawn portion of the cooled vent gases in the second heat exchanger to produce further cooled vent gases according to a desired temperature in the interior area; and circulating at least a portion of the further cooled vent gases to the interior area via a passage formed between double walls of the double-walled cover, for a flow of at least a portion of said further cooled vent gases from between the double walls and into the interior area to form a curtain of further cooled vent gases around the feeder pipe from where aluminium oxide powder is supplied to the bath.

8. A method of ventilating an aluminium production electrolytic cell, including a bath with contents, at least one cathode electrode in contact with said contents, at least one anode electrode in contact with said contents, and a hood, defining an interior area covering at least a portion of said bath, the method comprising:

drawing vent gases from said interior area through a cover interior area defined by a double-walled cover of an aluminium oxide feeder with each a crust breaker and a feeder pipe arranged within the cover interior area of the aluminium oxide feeder;

cooling at least a portion of said drawn vent gases to form cooled vent gases; and circulating at least a portion of said cooled vent gases to the interior area via a passage formed between double walls of the double-walled cover, for a flow of at least a portion of said cooled vent gases from between the double walls and into the interior area to form a curtain of cooled vent gases around the feeder pipe from where aluminium oxide powder is supplied to the bath.

* * * * *